US006612429B2

(12) United States Patent
Dennen

(10) Patent No.: US 6,612,429 B2
(45) Date of Patent: Sep. 2, 2003

(54) FLIP OPEN PACKAGE WITH MICROENCAPSULATED FLAVOR RELEASE

(75) Inventor: Robert P. Dennen, Plano, TX (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 68 days.

(21) Appl. No.: 09/887,212

(22) Filed: Jun. 22, 2001

(65) Prior Publication Data

US 2002/0195355 A1 Dec. 26, 2002

(51) Int. Cl.[7] ..... B65D 85/10
(52) U.S. Cl. ..... 206/268; 206/273
(58) Field of Search ..... 206/242, 264, 206/265, 268, 271, 273, 484, 484.2; 428/402.2, 905; 229/160.1, 87.13

(56) References Cited

U.S. PATENT DOCUMENTS

| | | | | |
|---|---|---|---|---|
| 3,599,859 A | | 8/1971 | Maierson | |
| 3,685,734 A | | 8/1972 | Paciorek et al. | |
| 4,105,144 A | | 8/1978 | Lin | |
| 4,243,224 A | | 1/1981 | Spector | |
| 4,349,104 A | | 9/1982 | Hayes | |
| 4,484,768 A | | 11/1984 | Norfleet | |
| 4,487,801 A | | 12/1984 | Turnbull et al. | |
| 4,493,869 A | | 1/1985 | Sweeny et al. | |
| 4,528,226 A | | 7/1985 | Sweeny | |
| 4,654,256 A | | 3/1987 | Doree et al. | |
| 4,687,203 A | | 8/1987 | Spector | |
| 4,717,017 A | | 1/1988 | Sprinkel, Jr. et al. | |
| 4,720,423 A | | 1/1988 | Fraser | |
| 4,817,860 A | | 4/1989 | Shapiro | |
| 4,847,124 A | | 7/1989 | Lux nee Andrieux | |
| 4,848,929 A | | 7/1989 | Rawl | |
| 4,925,517 A | | 5/1990 | Charbonneau et al. | |
| 5,000,486 A | | 3/1991 | Rua, Jr. et al. | |
| 5,249,676 A | | 10/1993 | Ashcraft et al. | |
| 5,355,551 A | | 10/1994 | Schechter et al. | |
| 5,381,984 A | * | 1/1995 | Hindsgual | 428/905 |
| 5,542,529 A | * | 8/1996 | Hein et al. | 206/273 |
| 5,779,519 A | | 7/1998 | Oliver | |
| 5,938,018 A | * | 8/1999 | Keaveney et al. | 206/268 |
| 6,216,859 B1 | * | 4/2001 | Manservigi et al. | 206/268 |

FOREIGN PATENT DOCUMENTS

| | | |
|---|---|---|
| GB | 1329309 | 9/1973 |

* cited by examiner

*Primary Examiner*—Luan K. Bui
(74) *Attorney, Agent, or Firm*—John F. Salazar; Charles G. Lamb; Middleton Reutlinger

(57) ABSTRACT

The invention relates to a flip open box package, such as a cigarette pack, with enhanced aroma due to encapsulated flavor materials incorporated on the interior surface of the flip top. The encapsulated flavor is released upon opening of the box by frictional interaction of frame components or with the product.

20 Claims, 2 Drawing Sheets

FLIP OPEN PACKAGE WITH MICROENCAPSULATED FLAVOR RELEASE

BACKGROUND OF THE INVENTION

1. Field of the Invention

The invention relates to a flip open package with microencapsulated flavor applied to the inner surface of the outer frame which is released to the air by frictional contact with the inner frame of the package as the top is opened.

2. Discussion of the Prior Art

Microencapsulation is a process by which a core material is captured within a second material or shell. It is well known in the field to encapsulate aromas and flavors in shells of varying sizes so that the flavor is preserved until the rupture of the capsule by mechanical or other force. Preservation of the flavor within the capsule assures that upon release of the flavor it is as consistently strong as when it was first encapsulated. "Flavor," "fragrance," "aroma," and like terms are used interchangeably herein to indicate any substance that is capable of causing an olfactory sensation.

A multitude of processes exists for manufacturing microcapsules. A variety of techniques can be utilized to produce microcapsules of varying sizes, differing resistances to rupture and alternative capsule compositions and capsule constituents. Several different encapsulation processes are disclosed in U.S. Pat. Nos. 3,516,846; 3,516,941; 3,778,383; 4,087,376; 4,089,802; 4,100,103 and 4,251,386 and British Patent Specification Nos. 1,156,725; 2,041,319 and 2,048,206. Common shell formations include the polymerization reaction of urea and formaldehyde and the polycondensation of methylated urea and aldehydes.

One manner of flavor-releasing package is disclosed in U.S. Pat. No. 4,717,017, which teaches a cigarette pack with a receptacle for containing a fragrance to be released upon initial opening by the consumer. The release points are disclosed to be along the tear strip portion of the overwrap film. When the tear tape is pulled to slit the overwrap, it also ruptures the receptacle, releasing a pleasant aroma to the consumer.

U.S. Pat. No. 4,720,423 teaches the use of microcapsules containing therein a fragrance in a multilayer adhesive strip. Separation of the adhered multilayers ruptures the microcapsules, releasing the fragrance. The multilayer adhesive strip is utilized as a tear strip for a package overwrap.

SUMMARY OF THE INVENTION

The object of the present invention is to provide a cigarette flip open box or other package that releases a pleasing aroma to the consumer upon opening.

It is a further object of the invention that the aroma is preserved against degradation until it is released upon opening of the box.

The objects of the invention are achieved by incorporating flavorants into microcapsules or similar flavor encapsulating materials. The encapsulated flavorants are adhered to the inside of the frame of a flip open box package so that the flavorant is released upon opening of the package top. Placement of the encapsulated flavorants is determined by consideration of the greatest points of frictional contact between box components and areas with the least direct consumer contact. The flavorant is released through frictional contact of the encapsulating materials on the box top with other structural elements of the box.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

DETAILED DESCRIPTION OF THE PREFERRED EMBODIMENT

Figure 1:
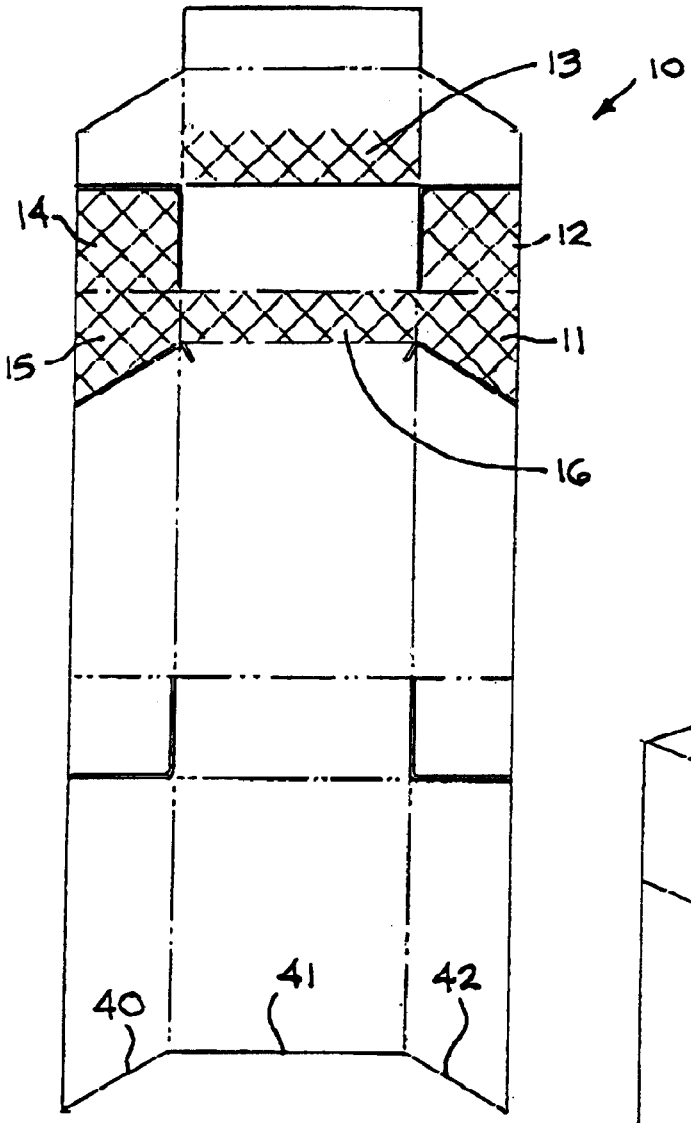
FIG. 1 is a top view of a blank cigarette flip open box frame.

A conventional blank cigarette flip open box outer frame 10 is shown in FIG. 1. The shaded areas on the blank show one possible option for regions printed with microcapsules. Referring to FIG. 1, areas which may be printed with the aroma-containing microcapsules in the exemplary embodiment of the present invention may be the lid inside right side wall flap 11, the lid inside top wall right flap 12, the bottom half of the lid inside front wall 13, the lid inside top wall left flap 14, the lid inside left side wall flap 15, and the lid inside back wall 16. As depicted therein, the flip open box 10 is substantially cuboidal in shape but many differing shapes may be utilized.

Figure 2:
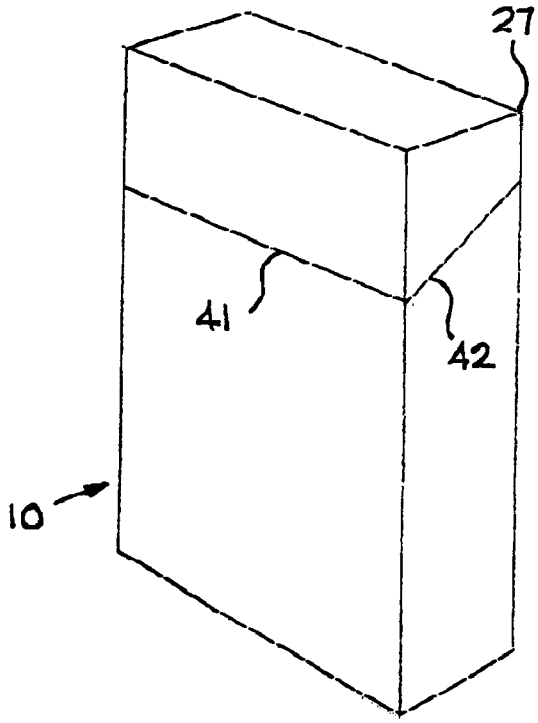
FIG. 2 is a perspective view of a closed flip open cigarette box in its assembled form.

When folded, the microcapsule-printed surfaces may constitute a majority of the inner surface of lid 27. In contrast, it is beneficial that direct consumer contact with the microcapsule-printed surfaces is kept to a minimum. FIG. 2 shows a completely assembled single frame carton package with lid 27 closed. No microcapsule-printed surfaces are exposed when the package lid 27 is closed. Standard gravure or screen printing processes may be utilized to apply the microcapsules to the interior package blanks.

Figure 3:
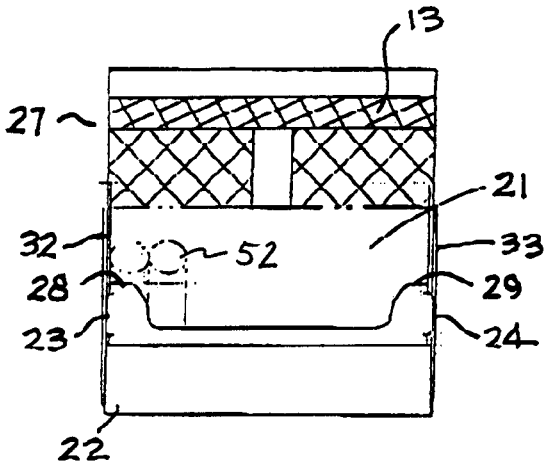
FIG. 3 is a top perspective view of an open flip open cigarette box in its assembled form with hatching indicating areas printed with microencapsulated flavors on the inside of the lid.
Figure 5:
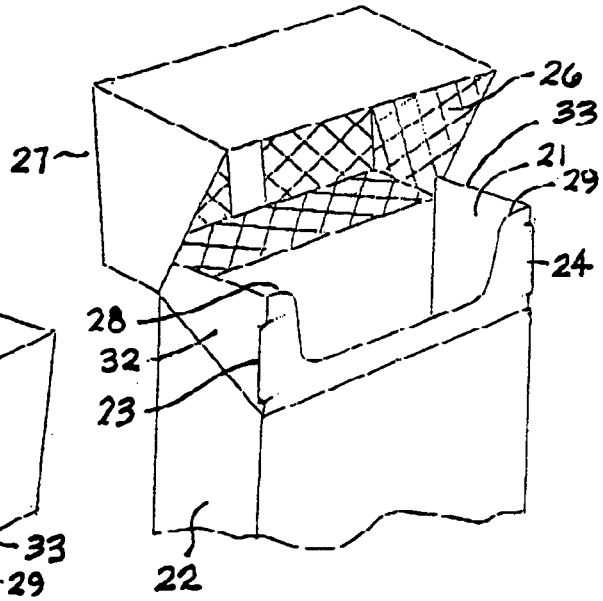
Figure 4:
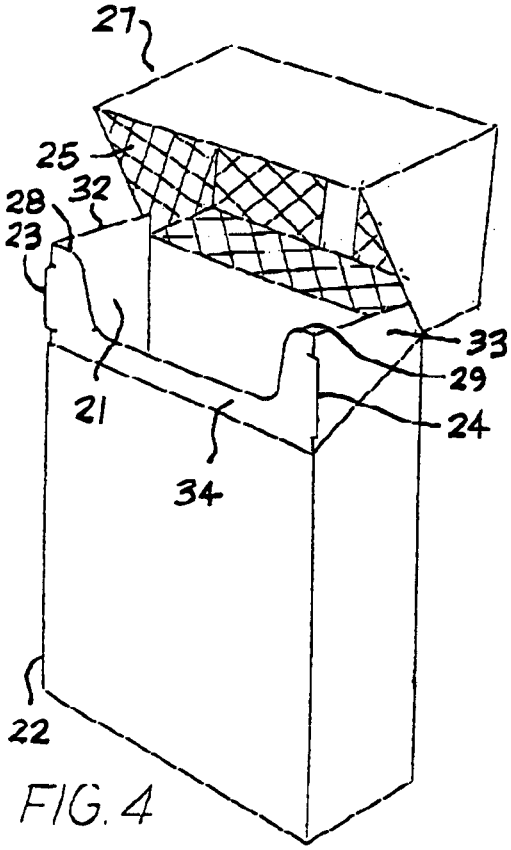
FIG. 4 is a right side perspective view of a partially open flip open cigarette box in its assembled form with hatching indicating areas which may be printed with microencapsulated flavors on the inside of the lid; and, FIG. 5 is a left side perspective view of a partially open flip open cigarette box in its assembled form with hatching indicating areas printed with microencapsulated flavors on the inside of the lid.

Areas chosen for printing are those in which frictional contact occurs between box components or box components and product upon opening and areas where consumer contact is least likely to occur. This may occur through the use of either single frame cartons as discussed above and shown in FIG. 1, or with cartons having an inner frame member as is shown in FIGS. 3, 4 and 5. For example, FIGS. 3, 4 and 5 illustrate a completely assembled flip open box with inner 21 and outer frames 22 joined and lid 27 opened. Inner frame fins 23 and 24 frictionally contact the microcapsules which may be printed on the lid left and right inner side walls 25 and 26. When the lid top 27 is opened, the microcapsules are ruptured releasing the contained aroma to the consumer. Similarly, inner frame ridges 28 and 29 also frictionally contact lid left and right inner side walls 25 and 26 and the inner front wall 13 when the lid is opened, rupturing other microcapsules and releasing more aroma to the consumer. In like manner, the inner frame side walls 32 and 33 also make frictional contact with lid left and right inner side walls 25 and 26, releasing encapsulated aroma to the consumer. Depending on product arrangement, the product or its covering may also frictionally contact one or more microcapsule coated inner surfaces of lid 27. Of course, the actual placement of the micro capsule coated inner surface on the flip top can vary quite extensively depending on the aromatic effect desired, strength of the flavorant encapsulated, extent of frictional engagement between the flip top and the lower body member, or other factors. Additionally, as can be seen from the figures, inner front side wall 13 of the flip top may actually contact the cigarettes 52 when it is opened thereby causing frictional engagement and release of flavorant.

An additional aspect of the designs depicted in FIGS. 1–5 is the usage on cigarette flip top boxes having either no inner frame 21, as depicted in FIG. 1 and 2, and that of FIGS. 3–5 wherein inner frame 21 extends upward from the top edge of the lower body outer frame member 22. As can be understood from the Figures, in FIGS. 1–2, the flip top 27 will contact upper edges 40–42 of the lower section of the package upon closing of the flip top. Thus, flavorant may be added as shown, on areas 11–16. Primarily, however, edges on panels 11 and 15 will contact and potentially frictionally engage edges 40 and 42. Alternatively, in FIGS. 3–5 and inner frame type flip open carton is utilized wherein first and second inner frame side panels 32 and 33 are provided with inner frame front panel 34. However, multiple variations are possible with many types of packaging designs and no particular embodiment set forth herein for exemplary purposes only should be read as limiting. The teachings of the present description is felt to cover a significant number of variants for enabling release of flavorants upon use or opening of the package 10.

Microcapsules containing an aroma of choice are manufactured and can be obtained commercially from companies such as Arcade, Inc., Chattanooga, Tenn. Examples of potential aromas for encapsulation include peppermint and roasted/toasted aromas. However, almost any flavor oil may be encapsulated so long as it meets certain basic requirements of the technology, such as having hydrophobic qualities. A solution of polyoxymethylene urea polymer may be used to coat the flavor oils and produce the microcapsules after polymerization. The microcapsules may range in size from about 10 to about 40 micrometers in diameter.

The microcapsules may be obtained as a wet cake that can be combined with water to produce an "ink" slurry. Solvents are not utilized in combination with the cake as they may dissolve the polymer shell surrounding the microencapsulated aroma. A variety of concentrations will result in a usable ink slurry depending on the printing conditions and processes. For example, a 50% to 60% concentration of wet cake produces ink of consistency usable for gravure printing systems. In gravure printing press runs, 40 kilograms of ink at a 50% dilution concentration may yield enough ink to print approximately one million flip open boxes. Screen printing processes may also be used with microencapsulation inks.

Thus, a flip open box package is provided which is strategically coated with microencapsulated aroma oil ink so that frictional contact between a coated surface and other surfaces of the package occurs upon opening by the consumer. Frictional contact ruptures the microcapsules releasing a fragrant aroma to the consumer. One skilled in the art will appreciate that the present invention can be practiced by other than the described embodiments, which are presented for purposes of illustration and not limitation, and the present invention is limited only by the claims which follow.

The forgoing detailed description is primarily given for clearness of understanding and no unnecessary limitations are to be understood therefrom for modifications will become obvious to those skilled in the art upon reading this disclosure and may be made without the parting from the spirit of the invention or the scope of the appending claims.

What is claimed is:

1. A flip top cigarette package, comprising:

a body outer frame member;

a flip top portion hingedly attached to said body outer frame member;

an inner frame member extending upwardly from said body outer frame member;

wherein said flip top portion has an interior surface thereof, said interior surface contacting at least a portion of said inner frame member when said flip top is closed onto said inner frame member, said interior surface of said flip top portion contacting said inner frame member having at least one area having encapsulated flavorant placed thereon.

2. The flip top package of claim 1 wherein said cigarette package is cuboidal.

3. The flip top package of claim 1 wherein said inner frame member extends upwardly from an upper edge of said body outer frame member and is spaced inwardly therefrom.

4. The flip top package of claim 3 wherein said inner frame member has at least one outwardly extending fin which frictionally engages said interior surface of said flip top portion.

5. The flip top package of claim 3 wherein said flip top portion is further comprised of a lid inside right side wall flap, a lid inside top wall right flap, a lid inside front wall, a lid inside top wall left flap, a lid inside left side wall flap and a lid inside back wall, wherein at least one of said lid inside right side wall flap, lid inside top wall right flap, lid inside front wall, lid inside top wall left flap, lid inside left side wall flap and lid inside back wall of said flip top portion contains said encapsulated flavorant placed thereon.

6. A flip top cigarette package, comprising:

a body outer frame member:

a flip top portion hingedly attached to said body outer frame member;

wherein said flip top portion has a lid interior front wall, said lid interior front wall having an upper portion and a lower portion, said lower portion of said interior front wall having an encapsulated flavorant placed thereon.

7. The flip top cigarette package of claim 6 further comprising an inner frame member extending upwardly from said body outer frame member, said flip top portion covering said inner frame member when said flip top is in a closed position.

8. The flip top cigarette package of claim 7 wherein said inner frame member has a front panel and a first and second side panel, said front panel having at least one outwardly extending fin formed therein, said fin frictionally contacting a surface on said interior of said inner frame member which has said encapsulated flavorant placed thereon.

9. A flip top cigarette package, comprising:

a body outer frame member;

a flip top portion hingedly attached to said body outer frame member;

wherein said flip top portion has an interior surface thereof, said interior surface having a lid inside right side wall flap, a lid inside top wall right flap, a lid inside front wall, a lid inside top wall left flap, a lid inside left side wall flap and a lid inside back wall, wherein at least one of said lid inside right side wall flap, lid inside top wall right flap, lid inside front wall, lid inside top wall left flap, lid inside left side wall flap and lid inside back wall of said flip top portion contains encapsulated flavorant placed thereon.

10. The flip top cigarette package of claim 9 further comprising an inner frame member extending upwardly from said body outer frame member, said inner frame member having a front panel and a first and a second side panel member.

11. A flavorant releasing flip open package comprising a lid portion and a package portion, an encapsulated flavorant affixed to an inner surface of said lid portion, said encapsulated flavorant positioned on said inner surface of said lid portion so that a flavorant in said encapsulated flavorant is released upon frictional contact between said lid portion and said package portion of said flip top package upon opening of said flip open package.

12. The flip open package of claim 11 wherein said encapsulated flavorant is comprised of microcapsules containing aroma oils.

13. The flip open package of claim 12 wherein said microcapsules are composed of polyoxymethylene urea polymer.

14. The flip open package of claim 13 wherein said microcapsules have a diameter size range of 10 to 40 micrometers.

15. The flip open package of claim 12 wherein said flavorant is selected from a group consisting of peppermint, roasted and toasted.

16. The flip open package of claim 11 wherein said encapsulated flavorant is printed on said lid portion so as to maximize frictional contact of said encapsulated flavorant with opposing surfaces of said package.

17. The flip open package of claim 11 wherein said encapsulated flavorant is a plurality of printed microcapsules diluted as an ink at a density of 50%.

18. A flip top cigarette package, comprising:

a body outer frame member;

a flip top portion hingedly attached to said body outer frame member;

wherein said flip top portion has an interior surface thereof, said interior surface having a lid inside right side wall flap, a lid inside top wall right flap, a lid inside front wall, a lid inside top wall left flap, a lid inside left side wall flap and a lid inside back wall, wherein at least one of said lid inside right side wall flap, lid inside top wall right flap, lid inside front wall, lid inside top wall left flap, lid inside left side wall flap and lid inside back wall of said flip top portion contains encapsulated flavorant placed thereon, wherein said encapsulated flavorant is diluted as an ink at a density of 50% and has a diameter size range of between about 10 to about 40 micrometers.

19. The flip open package of claim 18 wherein said encapsulated flavorant is comprised of microcapsules containing aroma oils.

20. The flip open package of claim 18 wherein said encapsulated flavorant has microcapsules which are composed of polyoxymethylene urea polymer.

* * * * *